US005297968A

United States Patent [19]

Johnson et al.

[11] Patent Number: 5,297,968

[45] Date of Patent: Mar. 29, 1994

[54] PLUGGABLE CONNECTOR SYSTEMS FOR FLEXIBLE ETCHED CIRCUITS

[75] Inventors: David C. Johnson, Winston Salem; Keith L. Volz, Jamestown; Warren A. Bates, Winston Salem; Frederick R. Deak, Kernersville; Robert M. Renn, Pfafftown, all of N.C.

[73] Assignee: The Whitaker Corporation, Wilmington, Del.

[21] Appl. No.: 3,161

[22] Filed: Jan. 12, 1993

[51] Int. Cl.[5] ..... H01R 9/09

[52] U.S. Cl. ..... 439/67; 439/91; 439/329

[58] Field of Search ..... 439/67, 329, 493, 496, 439/498, 499, 66, 91

[56] References Cited

U.S. PATENT DOCUMENTS

| | | | |
|---|---|---|---|
| 3,154,365 | 10/1964 | Crimmins | 439/67 |
| 3,486,159 | 12/1969 | Matthews | 439/496 |
| 3,753,207 | 8/1973 | Maheux et al. | 439/496 |
| 4,824,384 | 4/1989 | Nicholas et al. | 439/496 |
| 4,940,426 | 7/1990 | Redmond et al. | 439/493 |
| 5,161,981 | 11/1992 | Deak et al. | 439/66 |

*Primary Examiner*—Gary F. Paumen
*Attorney, Agent, or Firm*—William B. Noll

[57] ABSTRACT

A pluggable connector system (10) has a male housing (11, 11', 11'', 11''') snapped together with a female housing (12, 12', 12'', 12''') thereby providing a quick-disconnect feature. One of the housings, or both, carries a flexible etched circuit (16). The flexible etched circuit (16) may engage another flexible etched circuit (16) or, via a suitable interface, may engage a printed circuit board (17) having at least one circuit pad (19) thereon. One embodiment of a suitable interface is a flexible electrical connector (21) having a plurality of circuit traces on an elastomeric core. In another embodiment, the flexible etched circuit (16) is backed up by resilient means (33, 35) and engages the circuit pad (19) directly. The means for releasably retaining the housings (11, 11', 11'', 11''' and 12, 12', 12'', 12''') comprises a pair of spring-loaded manually-releasable latches (24, 24', 25) or a pair of bifurcated latching ears (43, 44).

12 Claims, 16 Drawing Sheets

PLUGGABLE CONNECTOR SYSTEMS FOR FLEXIBLE ETCHED CIRCUITS

FIELD OF THE INVENTION

The present invention relates to pluggable connector systems, and in particular, to simple and inexpensive pluggable connector systems for flexible etched circuits.

BACKGROUND OF THE INVENTION

Flexible etched circuits (sometimes referred to in the art as "FEC's") are widely used in the electrical and electronic industries. These flexible etched circuits comprise a plurality of finely-spaced circuit elements or traces formed (by optical or other suitable means) on a thin flexible sheet of insulating material, such as a polymeric film. These flexible etched circuits are connected to other circuit elements, or to each other, by means of a suitable interface.

One such interface (as disclosed in U.S. Pat. No. 5,161,981, issued on Nov. 10, 1992) employs a flexible electrical connector comprising a plurality of finely-spaced circuit elements or traces formed on an elastomeric core. The traces may be formed from a gold-plated nickel-clad copper foil for superior conductivity. Typically, these traces are 3 mils wide with a 7 mils center-to-center spacing, such that the traces have a 4 mils spacing therebetween. A complete line of flexible electrical connectors is supplied by AMP Incorporated of Harrisburg, Pa. under its registered "AMPLIFLEX" trademark.

The prior art systems, which use these flexible etched circuits and their respective interfaces (such as flexible electrical connectors) in overall connector systems, are not pluggable and unpluggable. While perfectly suitable for the purposes intended, nevertheless, these prior art systems increase the production assembly time for the products employing the flexible etched circuits and, besides, are somewhat inconvenient and time-consuming for product service, upgrading and repair out in the field.

SUMMARY OF THE INVENTION

Accordingly, it is an object of the present invention to provide pluggable connector systems for flexible etched circuits, which are simple and inexpensive, provide a quick-disconnect feature, and facilitate upgrading and maintenance of the equipment out in the field.

It is a further object to employ an inherent modular design concept for pluggable connector systems involving flexible etched circuits, thereby facilitating manufacturing standardization and avoiding lengthy product development cycles and costly re-tooling.

In accordance with the teachings of the present invention, there is herein disclosed and claimed, a pluggable connector system including a first housing carrying a flexible etched circuit, and further including a second housing receiving the first housing in at least a partially nested relationship therebetween. A quick-disconnect retaining means is provided for releasably retaining the first and second housings together, thereby providing a pluggable system. A circuit means is associated with the second housing, and means are provided for establishing electrical contact between the flexible etched circuit and the circuit means when the housings are in their nested relationship.

Preferably, the first housing comprises a male housing, the second housing comprises a female housing, and the male housing has bifurcated side portions which straddle the female housing.

In one embodiment, the retaining means includes a pair of spring-loaded manually-releasable pivoting latches carried by the male housing and having respective hooks; and the female housing has respective undercut latch shoulders engaging the respective hooks, such that the male housing is "snapped" over the female housing.

In an alternate embodiment, the retaining means includes a pair of bifurcated latching ears on the female housing; and the male housing has latch shoulders cooperating with the latching ears, such that the latching ears may be squeezed together to release the latching ears from the latch shoulders, and such that the housings may be quickly disconnected.

Preferably, a flexible electrical connector is housed in an opening in the female housing and is disposed between the flexible etched circuit on the male housing and a circuit pad on a printed circuit board, thereby providing a resiliently-biased circuit interface therebetween.

Alternatively, the male housing has a pocket formed therein; a resilient means is disposed in the pocket, and the resilient means bears directly on the flexible etched circuit and constantly urges the flexible etched circuit into direct contact with the circuit pad on the printed circuit board.

These and other objects of the present invention will become apparent from a reading of the following specification taken in conjunction with the enclosed drawings.

BRIEF DESCRIPTION OF THE DRAWINGS

FIG. 3 is a further exploded perspective, corresponding substantially to FIG. 2, but showing certain parts broken away and sectioned.

GENERAL DESCRIPTION OF THE PREFERRED EMBODIMENTS

Figure 1:
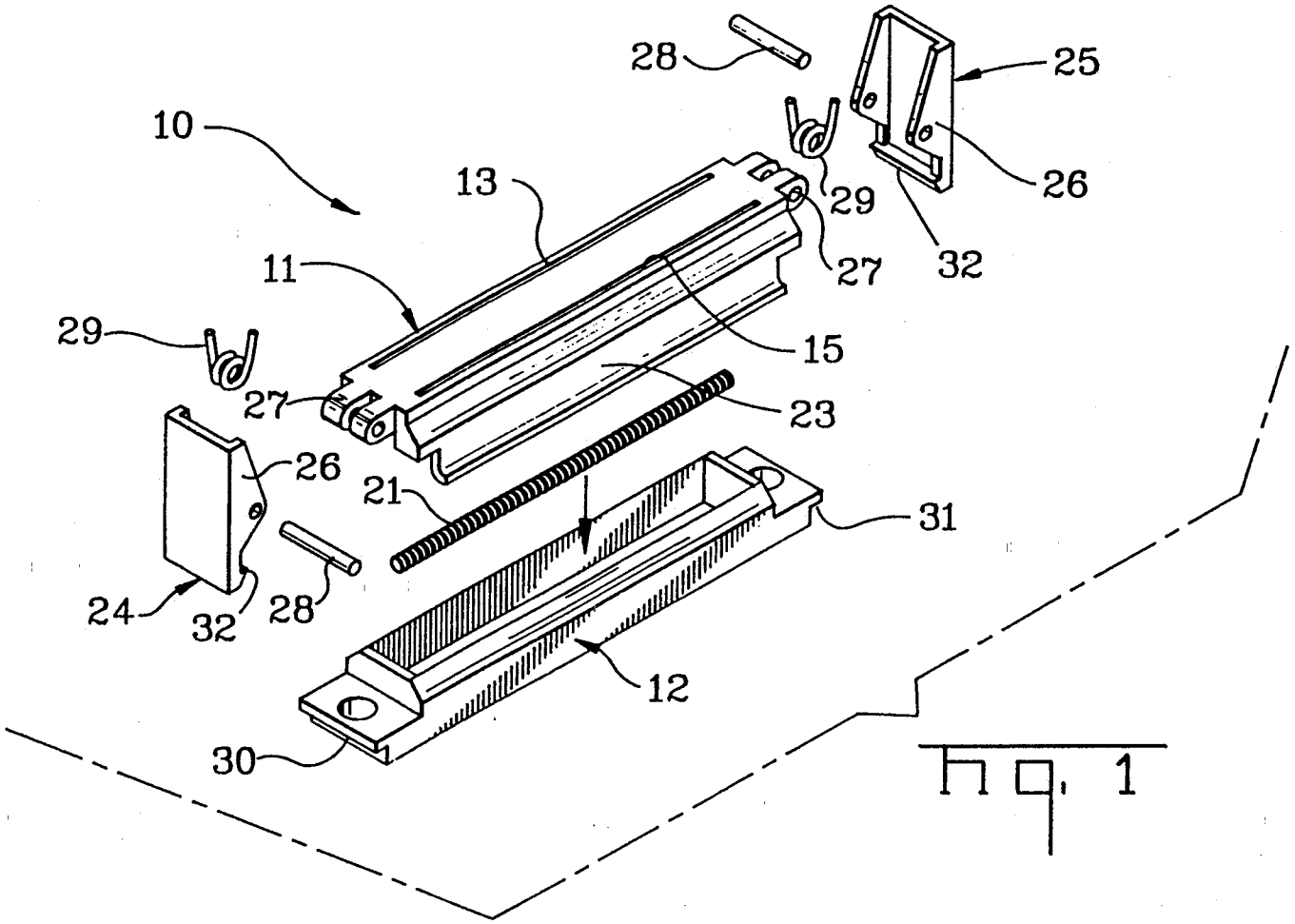
FIG. 1 is an exploded perspective view of one embodiment of the present invention, including a "pluggable" male housing carrying a flexible etched circuit, a female housing carrying a flexible electrical connector, and a pair of spring-loaded pivoted latches carried by the male housing and engaging respective latch shoulders on the female housing.
Figure 2:
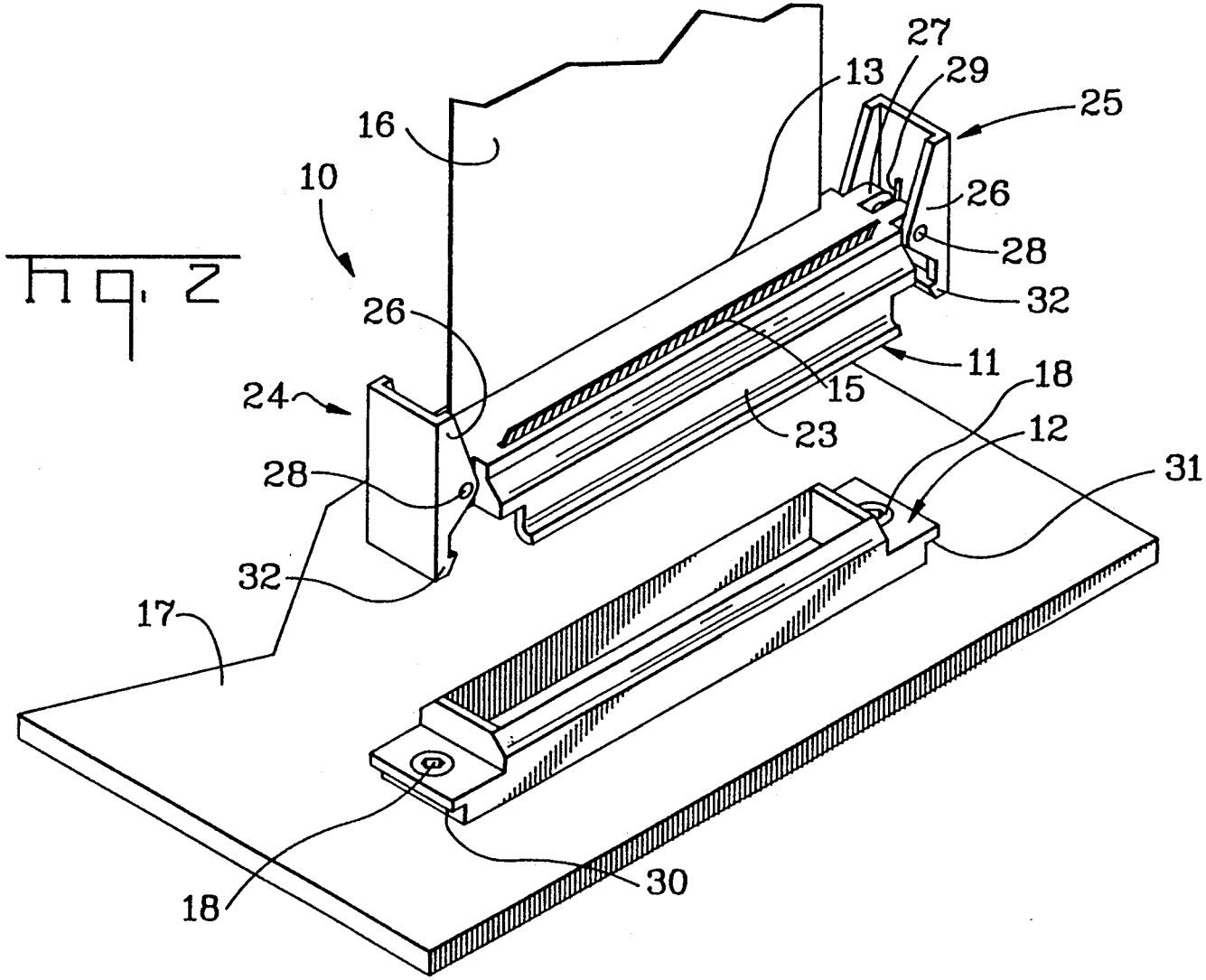
FIG. 2 is a further exploded perspective view, corresponding substantially to FIG. 1, but showing the components thereof partially assembled.

With reference to FIGS. 1–6, a pluggable connector system 10 includes a male housing 11 adapted to nest at least partially with a female housing 12. The male housing 11 has an entrance slot 13, an underside portion 14, and an exit slot 15. A flexible etched circuit 16, carried by the male housing 11, enters the entrance slot 13, is wrapped around the underside portion 14, and exits out of the exit slot 15 (as shown more clearly in FIGS. 4 and 5).

The female housing 12 is mounted on a printed circuit ("PC") board 17 and is secured thereto by suitable fasteners 18. The printed circuit board 17 has at least one circuit element or pad 19 thereon; and the female housing 12 has an opening 20 receiving a flexible electrical connector 21, the flexible electrical connector 21 thereby providing an electrical interface between the flexible etched circuit 16 on the male housing 11 and the circuit pad 19 on the printed circuit board 17. The male housing 11 has a pair of side portions 22 and 23, respectively, which straddle the female housing 12 (as shown more clearly in FIG. 5) and, preferably, each of the housings 11, 12 is molded from a suitable plastic material.

A pair of spring-loaded manually-releasable latches 24 and 25, respectively, are carried on the male housing 11. More specifically, each latch 24, 25 has an intermediate portion 26 pivoted on a slotted boss 27 on the male housing 11 by means of a transverse pivot pin 28. A torsion spring 29 is mounted on the boss 27, is disposed between a latch 24, 25 and the male housing 11 as shown more clearly in FIG. 6, and constantly urges each latch 24, 25 into its latched or locking position. The female housing 12, in turn, has a complementary pair of latch shoulders 30 and 31, respectively, for receiving the hook portion 32 of each latch 24, 25.

Figure 7:
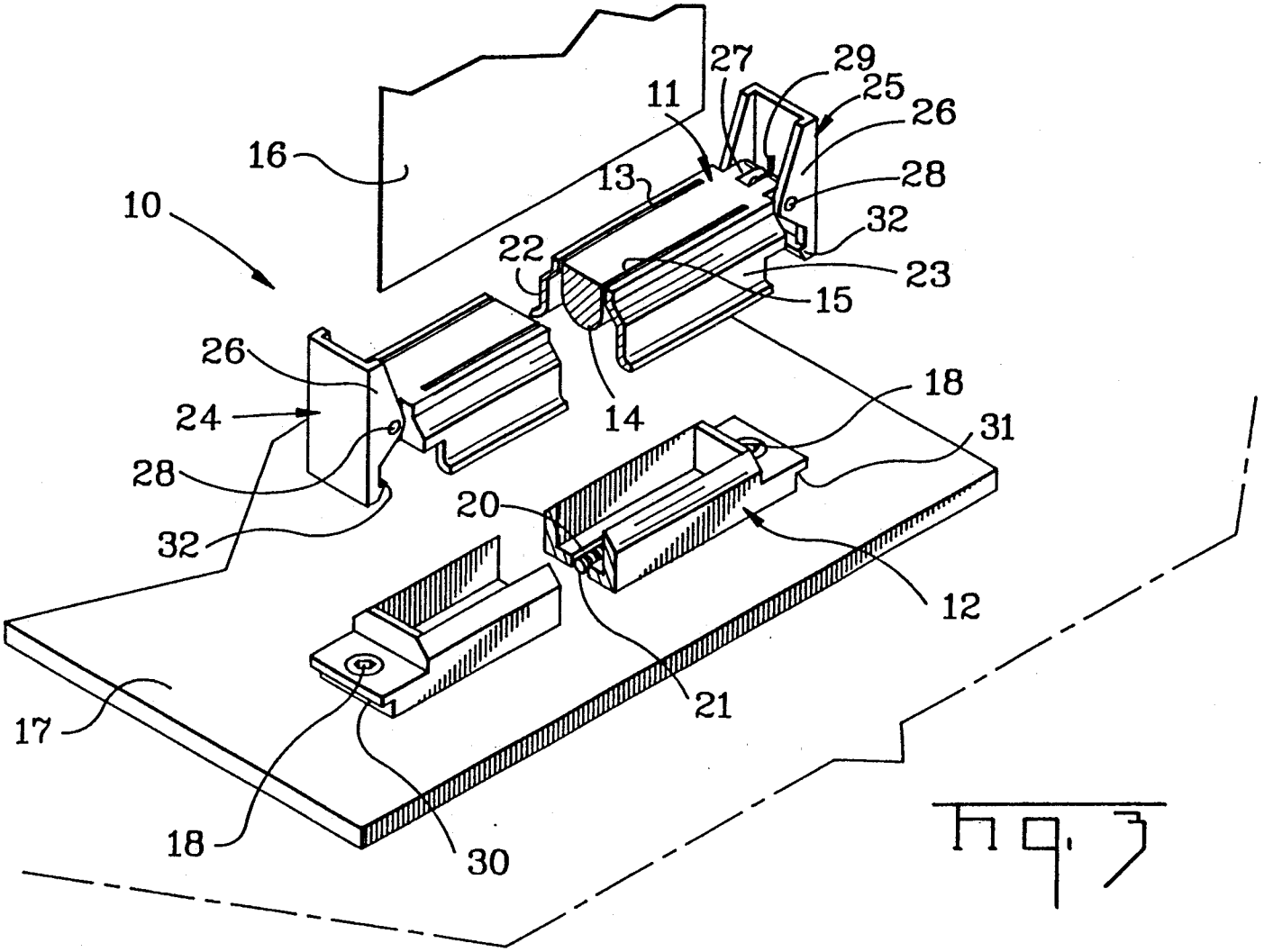
FIG. 7 is a further cross-sectional view, showing how the pair of latches may be squeezed together to release the latches, thereby enabling the pluggable housings to be quickly disconnected.
Figure 4:
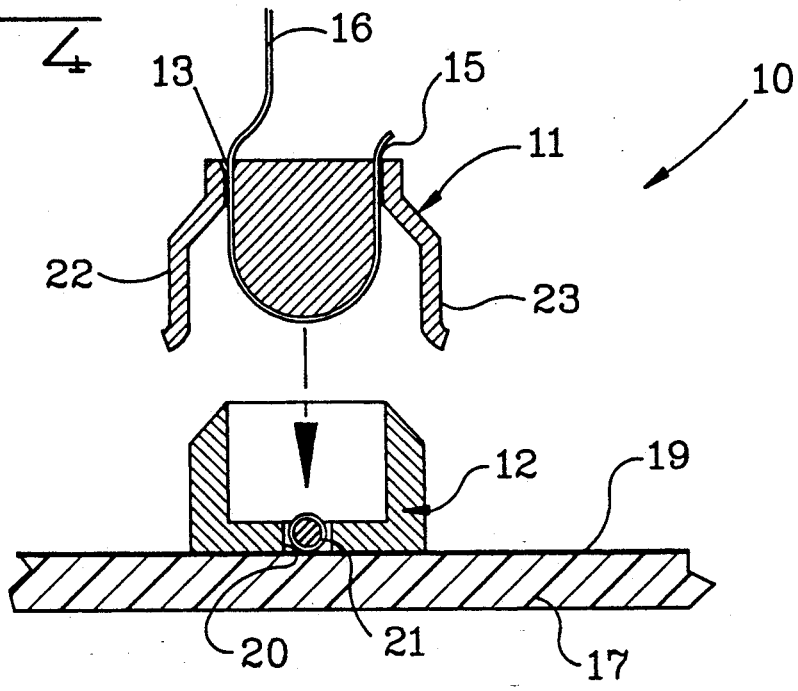
FIG. 4 is a cross-sectional exploded view, showing the "pluggable" male housing with its flexible etched circuit, and further showing the female housing carried by a printed circuit board, the female housing including a flexible electrical connector providing an interface between the flexible etched circuit on the male housing and a circuit pad on the printed circuit board.
Figure 5:
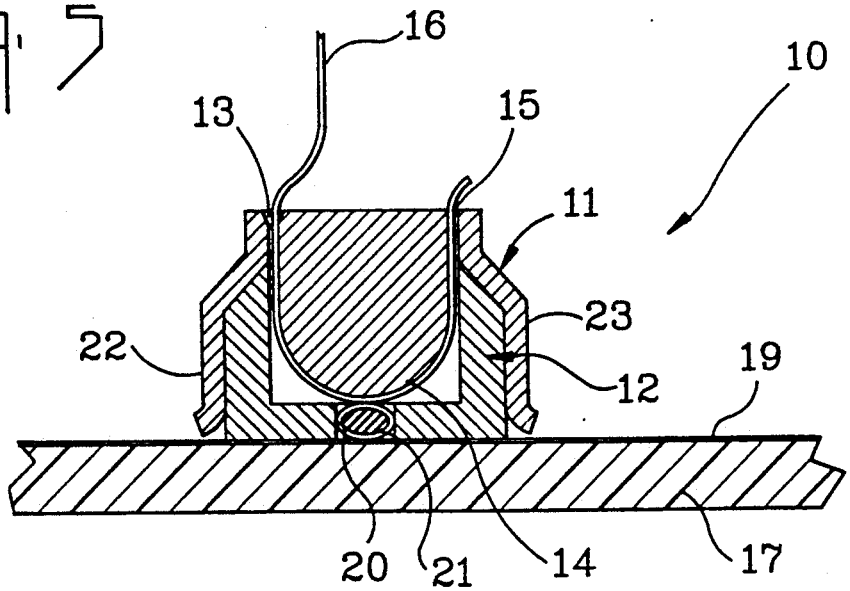
FIG. 5 is a further cross-sectional view, corresponding substantially to FIG. 4, but showing the male housing nested within the female housing.
Figure 6:
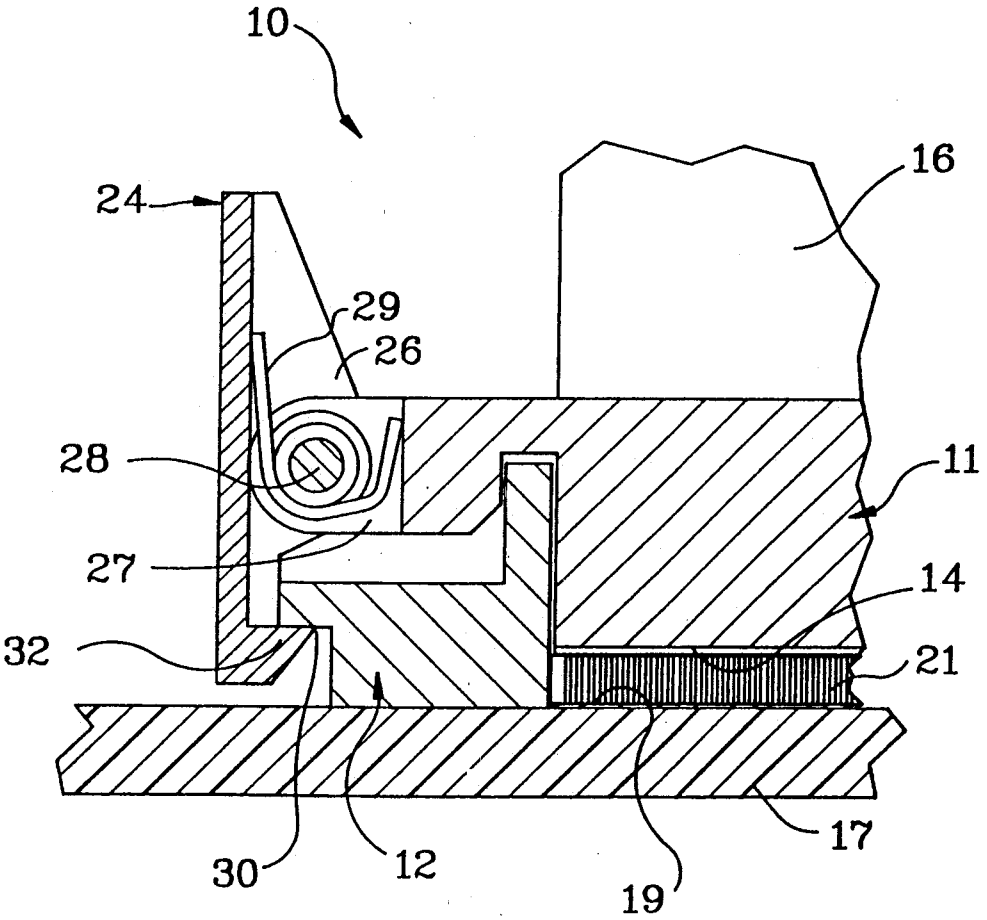
FIG. 6 is a cross-sectional view showing one of the spring-loaded pivoted latches carried by the male housing and engaging a latch shoulder on the female housing.
Figure 7:
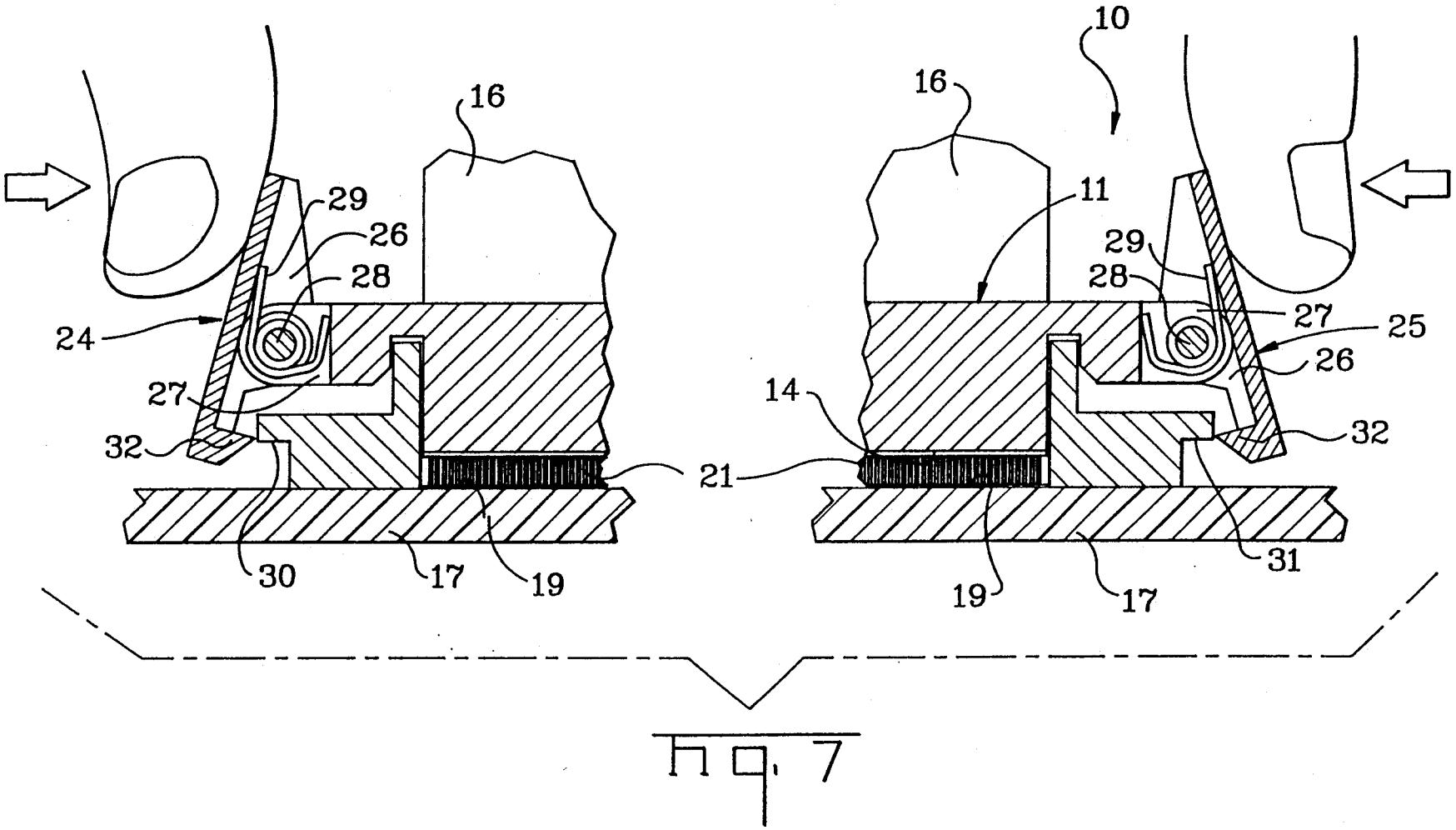

As shown in FIG. 7, the latches 24, 25 may be squeezed together to quickly disconnect the latches 24, 25 and enable the pluggable male housing 11, carrying the flexible etched circuit 16, to be easily and conveniently removed from the female housing 12. This quick-disconnect feature between pluggable housings 11 and 12, at least one of which carries a flexible etched circuit 16, is very desirable in the design, manufacture, servicing and upgrading of sophisticated electrical and electronic equipment within which flexible electrical connectors 16 are widely used.

Figure 8:
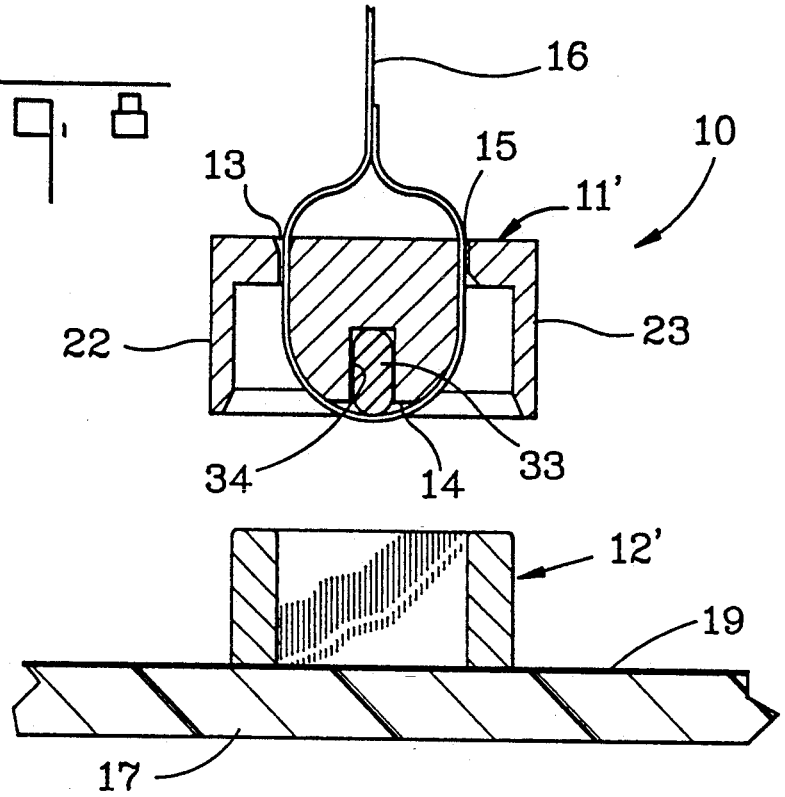
FIG. 8 and 9 are cross-sectional views, corresponding substantially to FIGS. 4 and 5, but showing the flexible etched circuit directly engaging the circuit pad on the printed circuit board, and further showing an elastomeric compressive member carried in a pocket on the male member and bearing against the flexible etched circuit (on the inside thereof) to constantly urge the flexible etched circuit into engagement with the circuit pad.
Figure 9:
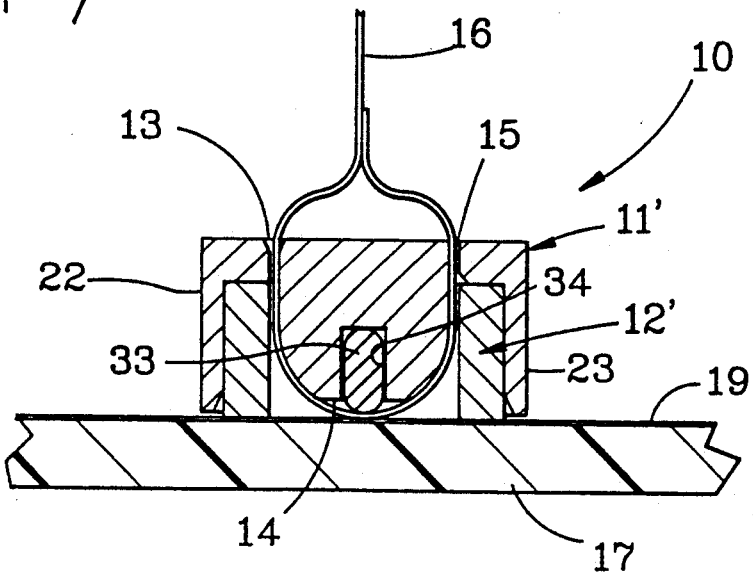

With reference to FIGS. 8 and 9, a male housing 11' nests with a female housing 12'. The flexible etched circuit 16 carried by the male housing 11' directly engages the circuit pad 19 on the printed circuit board 17. An elastomeric compressible member 33 is received in a blind pocket 34 formed in the male member 11'. This elastomeric compressible member 33 bears against the flexible etched circuit 16 (on the inside thereof) and resiliently urges the flexible etched circuit 16 into contact with the circuit pad 19.

Figure 10:
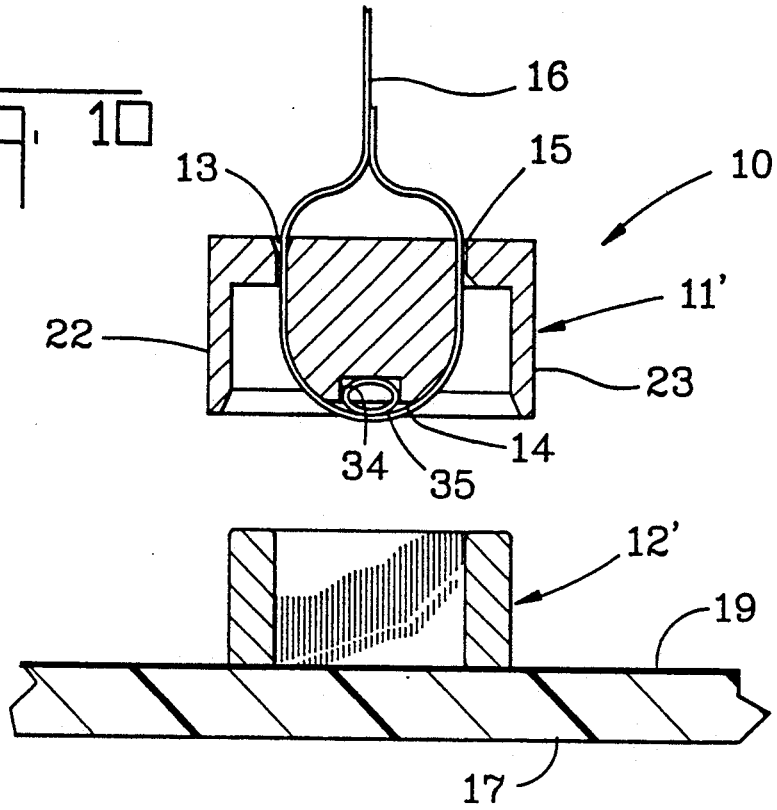
FIGS. 10 and 11 are further cross-sectional views, corresponding substantially to FIGS. 8 and 9, respectively, but showing the use of a canted coil spring in lieu of an elastomeric compressive member.
Figure 11:
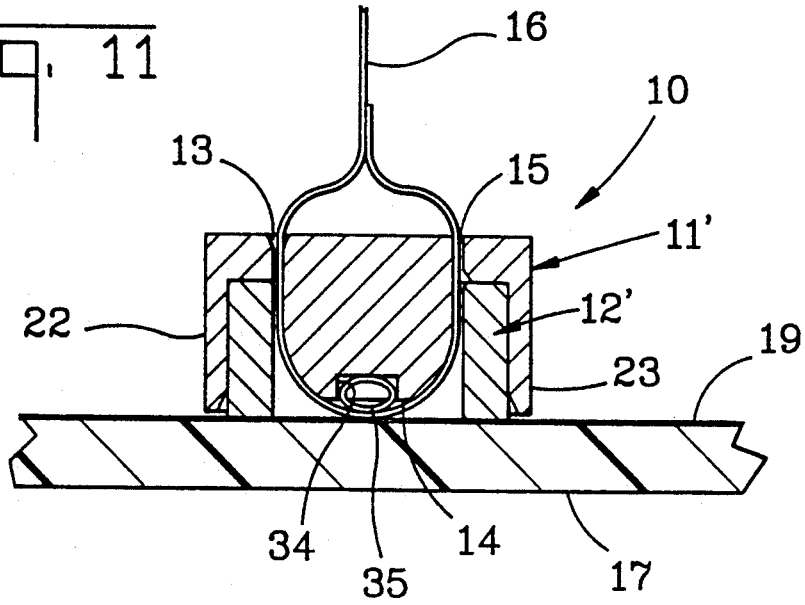

With reference to FIGS. 10 and 11, the elastomeric compressive member 33 may be replaced by a canted coil spring 35, if desired.

Figure 12:
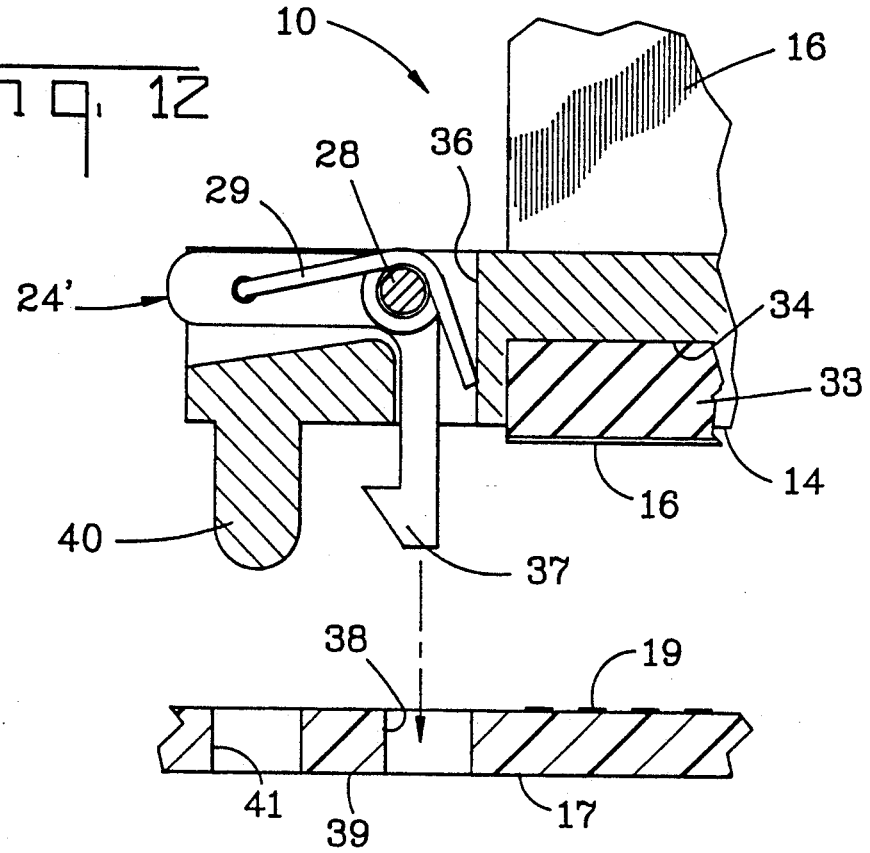
FIG. 12 is a cross-sectional view, corresponding substantially to FIG. 6, but showing an alternate construction of the pivoted latch.
Figure 13:
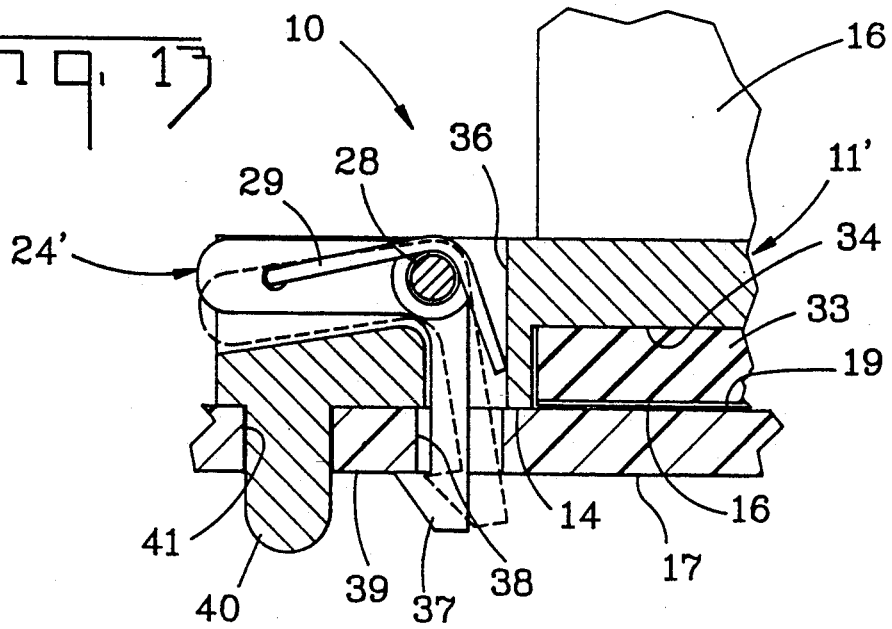
FIG. 13 is a cross-sectional view, corresponding substantially to FIG. 12, but showing the latch released to quickly disconnect the male housing from the female housing.
Figure 14:
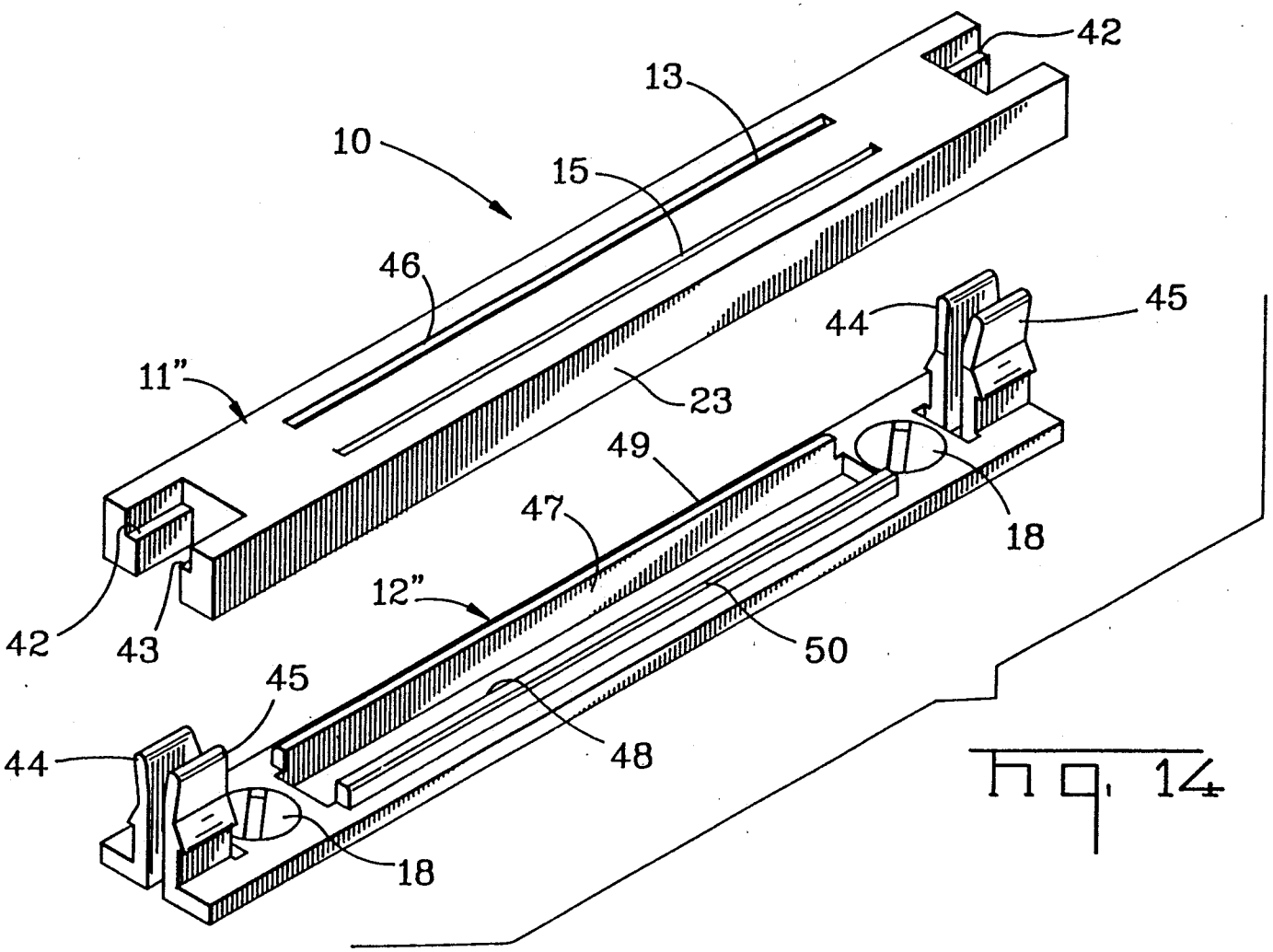
FIG. 14 is an exploded perspective view of another embodiment of the present invention, in which spaced-apart pairs of bifurcated latching ears are formed on the female housing for cooperation with complementary latch shoulders on the male housing.
Figure 15:
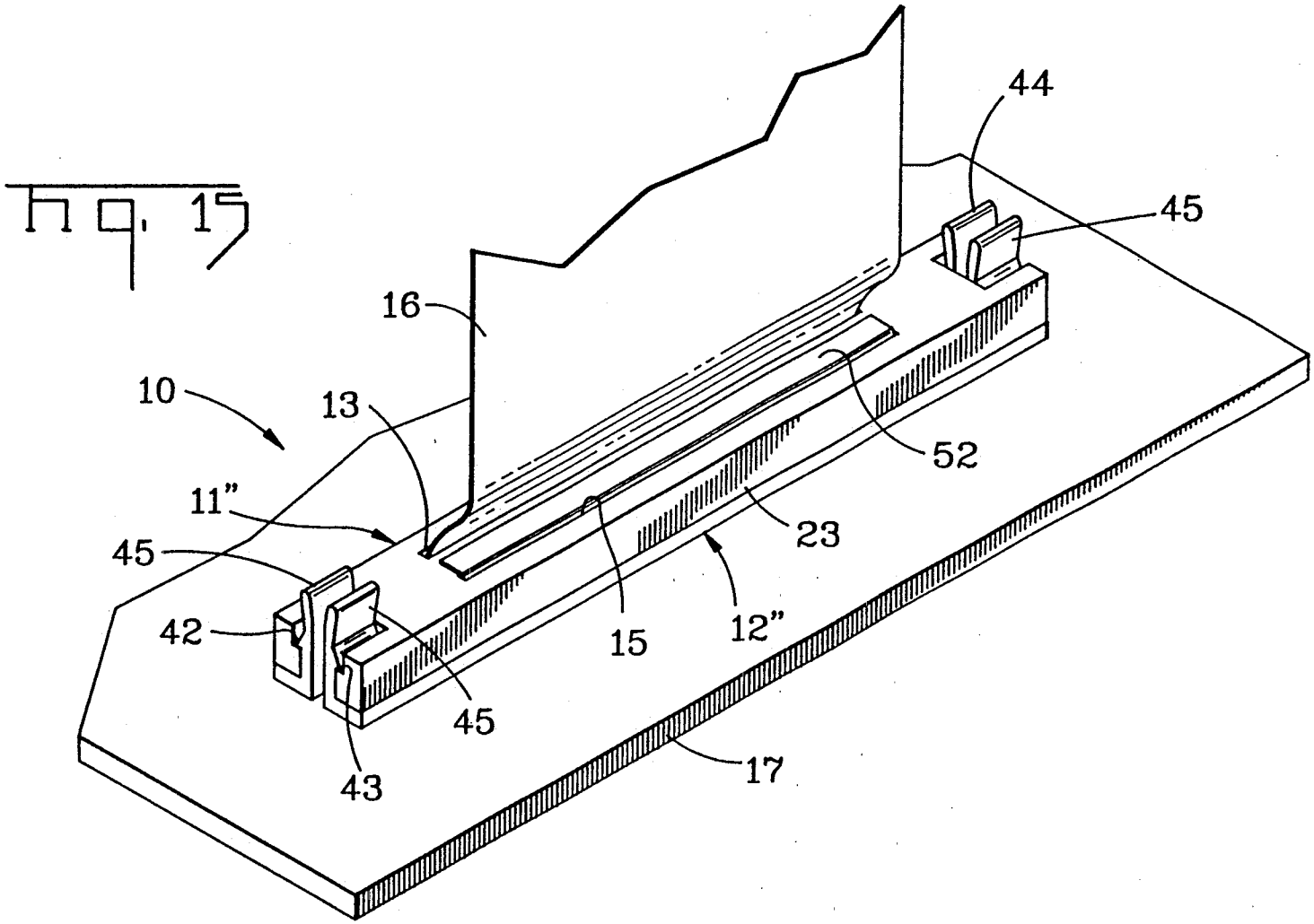
FIG. 15 is a perspective view, corresponding substantially to FIG. 14, but showing the parts in their assembled relationship, and further showing a flexible etched circuit carried by the male housing.

With reference to FIGS. 12 and 13, a latch 24' is disposed in a slotted recess 36 in a housing 11'. The latch 24', which is generally in the form of a bell crank, is pivoted on pin 28 and is biased by spring 29. A hook 37 on the latch 24' extends through an opening 38 in the printed circuit board 17 and directly engages the bottom surface 39 thereof. When the latch 24' is depressed, the hook 37 is released from the surface 39, and the pluggable housing 11' is quickly disconnected from the printed circuit board 17. Preferably, a downwardly-projecting guide pin 40 on the housing 11' is received in an alignment hole 41 in the printed circuit board 17, thereby aligning the housing 11' and the circuitry on the printed circuit board 17.

Figure 20:
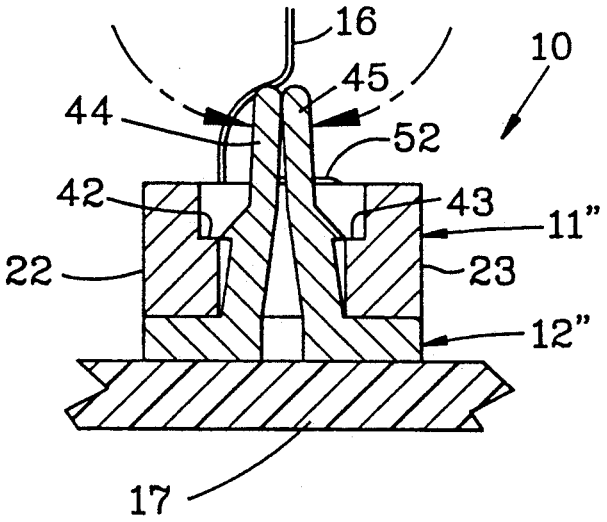
FIG. 20 corresponds to FIG. 19, but shows the latching ears squeezed together to disengage the respective latch shoulders, thereby facilitating a quick-disconnect of the pluggable connectors.

With reference to FIGS. 14–20, a pluggable male housing 11" has latch shoulders 42, 43 cooperating with latching ears 44 and 45, respectively, formed on the female housing 12". The latching ears 44, 45 may be squeezed together (as shown in FIG. 20) to release the latching ears 44, 45 from the respective latch shoulders 42, 43, thereby enabling the male housing 11" to be quickly disconnected from the female housing 12". Preferably, two pairs of cooperating latching ears 44, 45 and latch shoulders 42, 43 are provided, as shown more clearly in FIGS. 14 and 15.

Figure 16:
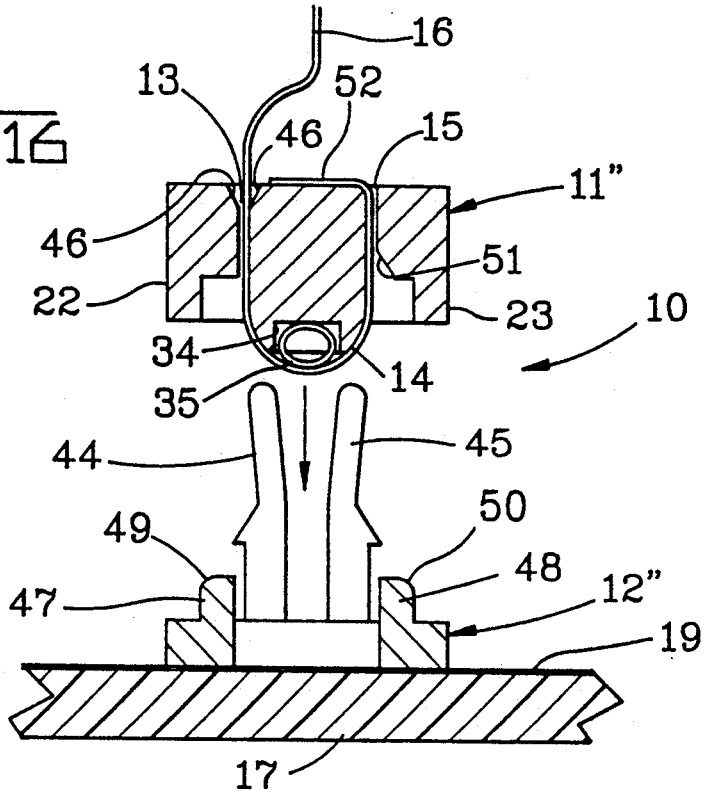
FIG. 16 is an exploded cross-sectional view thereof, showing the flexible etched circuit backed by a canted coil spring carried by the male housing.
Figure 17:
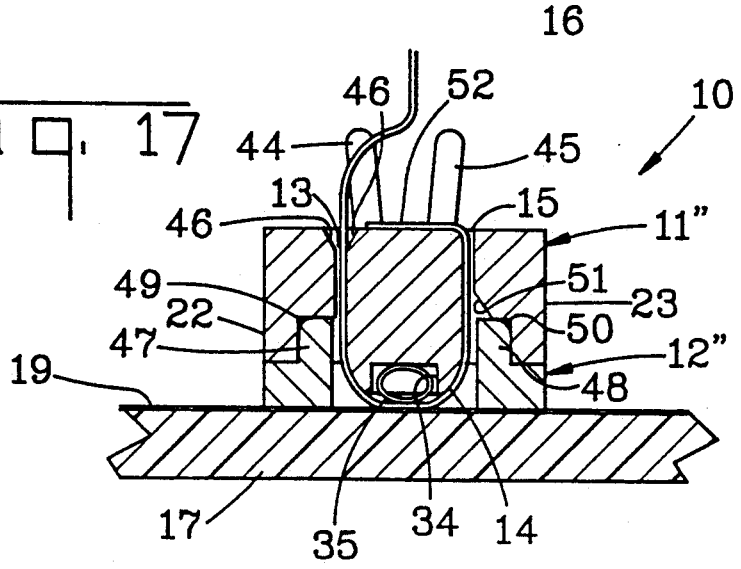
FIG. 17 corresponds to FIG. 16, but shows the parts assembled.
Figure 18:
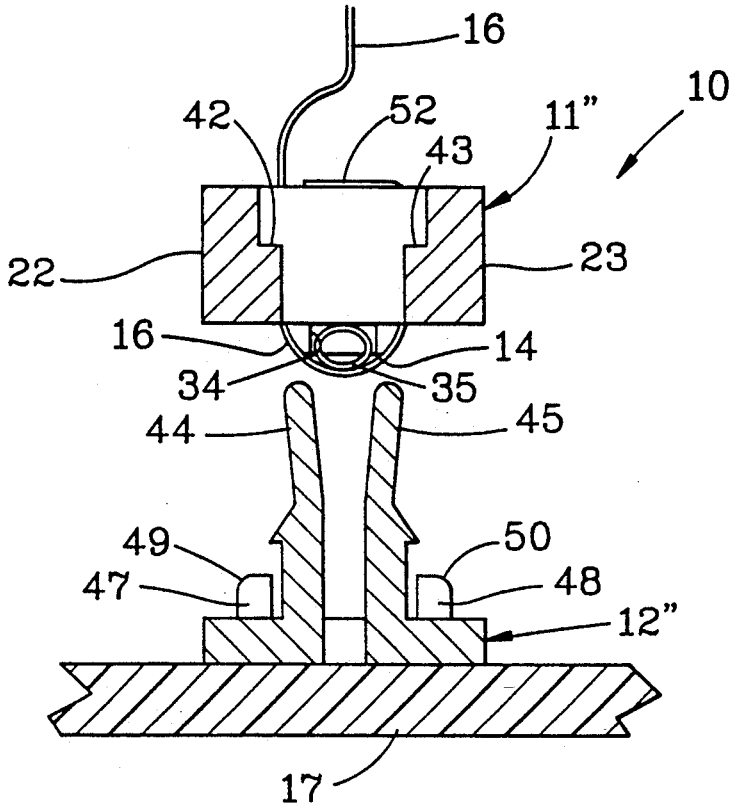
FIG. 18 is a further exploded cross-sectional view, showing the latching ears.
Figure 19:
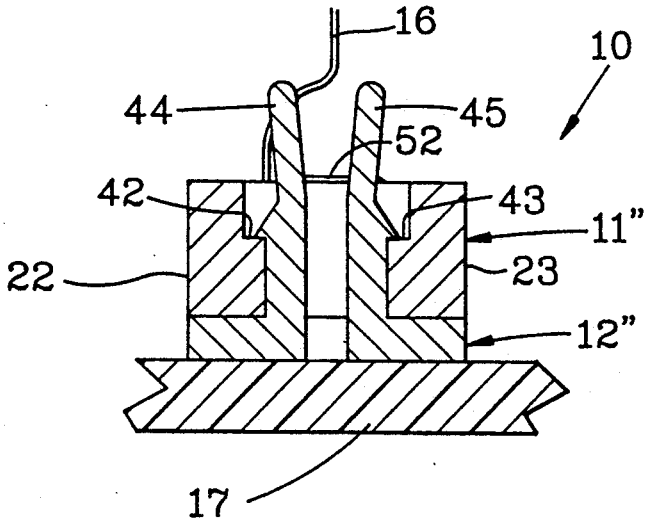
FIG. 19 corresponds to FIG. 18, but shows the latching ears engaging the respective latch shoulders.

The entrance slot 13 in the male housing 11'' has a longitudinally-extending beveled surface 46 as shown in FIGS. 16 and 17, to facilitate sliding the flexible etched circuit 16 into the male housing 11''. The female housing 12'' has parallel longitudinally-extending guide ribs 47 and 48, respectively, which are spaced laterally of each other. These guide ribs 47, 48 have rounded surfaces 49 and 50, respectively, to facilitate the rapid mating engagement between the pluggable male and female housings 11'' and 12'', respectively. The male housing 11'' further has a longitudinally-extending beveled surface 51 to facilitate the exit of the flexible etched circuit 16 out of the exit slot 15 in the male housing 11'', as shown in FIGS. 16 and 17. Moreover, the flexible etched circuit 16 has a tail portion 52 heat-sealed or otherwise secured to the male housing 11''.

Figure 21:
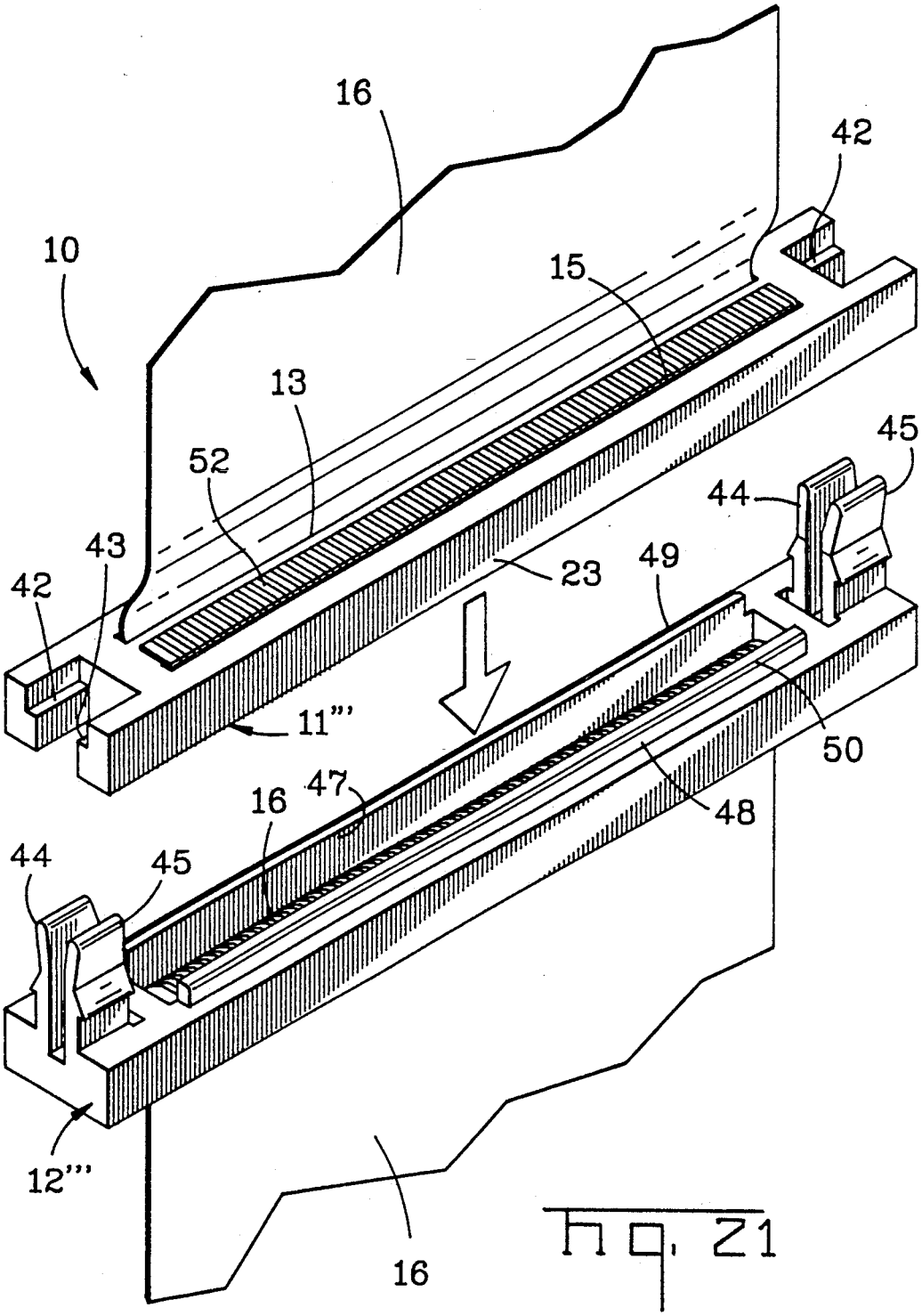
FIG. 21 is an exploded perspective, showing a flexible etched circuit carried by each of the housings.
Figure 22:
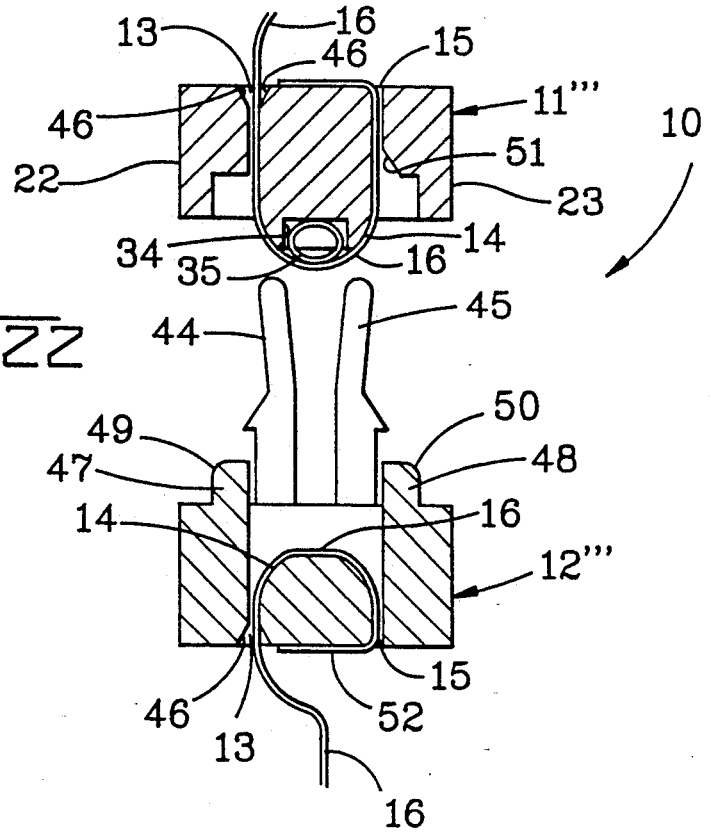
FIG. 22 is an exploded cross-sectional view thereof.
Figure 23:
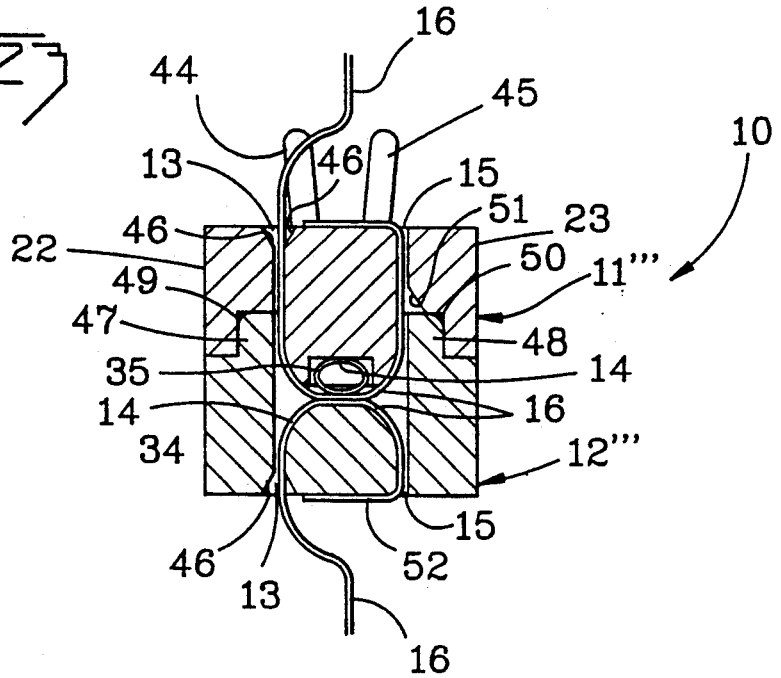
FIG. 23 is a further cross-sectional view, corresponding substantially to FIG. 22, but showing the parts assembled.

With reference to FIGS. 21–23 both the pluggable male housing 11''' and the female housing 12''' carry a flexible etched circuit 16.

From the foregoing, it will be appreciated that a truly pluggable system has been provided for quickly snapping together (or just as quickly disconnecting) a pair of cooperating male and female housings (11, 12) (11', 12') (11'', 12'') or (11''', 12'''), respectively, at least one of which carries a flexible etched circuit 16. Thus, a high degree of design flexibility, product reliability and manufacturing standardization is achieved for superior end products manufactured economically and with marketable features and advantages.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A pluggable connector system including at least one flexible etched circuit, comprising a first housing, a flexible etched circuit carried by the first housing, a second housing receiving the first housing in at least a partially nested relationship therebetween, quick-disconnect retaining means for releasably retaining the first and second housings as the housings are nested, circuit means associated with the second housing, wherein said circuit means comprises at least one circuit pad on a printed circuit board, wherein the second housing comprises a connector housing secured to the printed circuit board and having an opening formed therein, and wherein a flexible electrical connector is received in the opening in the connector housing, the flexible electrical connector interfacing between a flexible etched circuit and the circuit pad, and means for establishing electrical contact between the flexible etched circuit and the circuit means when the housings are in their nested relationship.

2. The pluggable connector system of claim 1, wherein the first housing comprises a male housing and the second housing comprises a female housing, and wherein the male housing has bifurcated side portions which straddle the female housing.

3. The pluggable connector system of claim 2, wherein the retaining means comprises a pair of spring-loaded manually-releasable pivoting latches carried by the male housing and having respective hooks, and wherein the female housing has respective undercut latch shoulders engaging the respective hooks, such that the male housing is snapped over the female housing.

4. The pluggable connector system of claim 2, wherein the male housing has an underside portion and further has a pair of longitudinally-extending parallel slots formed therein and comprising respective entrance and exit slots for the flexible etched circuit, such that the flexible etched circuit is received in the entrance slot in the male housing, is wrapped around an underside portion thereof, and exits out of the exit slot thereof.

5. The pluggable connector system of claim 1, wherein the first housing has a pocket formed therein, and wherein a resilient means is disposed in the pocket, the resilient means bearing directly on the flexible etched circuit and constantly urging the flexible etched circuit into direct contact with the circuit pad on the printed circuit board.

6. The pluggable connector system of claim 5, wherein the resilient means comprises an elastomeric compressive member.

7. The pluggable connector system of claim 5, wherein the resilient means comprises a canted coil spring.

8. The pluggable connector system of claim 1, wherein the retaining means comprises a pair of bifurcated latching ears on one of the housings, and wherein the other housing has latch shoulders cooperating with the latching ears, whereby the latching ears may be squeezed together to release the latching ears from the latch shoulders, such that the housings may be quickly disconnected.

9. The pluggable connector system of claim 1, wherein each of the housings carries a flexible etched circuit.

10. A pluggable connector system, comprising a male housing carrying a flexible etched circuit, a printed circuit board having at least one circuit pad thereon, a female housing on the printed circuit board, a flexible electrical connector in the female housing and interfaced between the flexible etched circuit and the circuit pad, resiliently-biased manually-releasable latch means carried by one of the housings, and the other housing having respective latch shoulders engaging the latch means, such that the male housing may be "snapped" on to the female housing, such that the latch means automatically engage the latch shoulders to retain the male and female housings, and such that the latch means may be depressed to release the latch means from the latch shoulders, thereby providing a quick-disconnect between the male and female housings.

11. The pluggable connector system of claim 10, wherein the latch means comprises a pair of spring-loaded pivoted latches carried by the male member, and wherein the latch shoulders are formed on the female member.

12. A pluggable connector system, comprising a male housing carrying a flexible etched circuit, a printed circuit board having at least one circuit pad thereon, a female housing on the printed circuit board, the female housing having an opening therein for receiving the male housing, such that the flexible etched circuit engages the circuit pad directly, spring-loaded manually-releasable latch means carried by one of the housings, and the other housing having respective latch shoulders engaging the latch means, such that the male housing may be "snapped" on to the female housing, such that the latch means automatically engage the latch shoulders to retain the male and female housings, and such that the latch means may be depressed to release the latch means from the latch shoulders, thereby providing a quick-disconnect between the male and female housings.

* * * * *